US006039126A

United States Patent [19]

Hsieh

[11] Patent Number: 6,039,126

[45] Date of Patent: Mar. 21, 2000

[54] MULTI-USAGE ELECTRIC TOOL WITH ANGLE-CHANGEABLE GRIP

[76] Inventor: An-Fu Hsieh, 5F, No. 79, Kuei-Hsin Rd., Pan-Chiao City, Taipei Hsien, Taiwan

[21] Appl. No.: 09/079,406

[22] Filed: May 15, 1998

[51] Int. Cl.[7] ..... B25B 45/00; B25B 45/02

[52] U.S. Cl. ..... 173/216; 173/29; 173/170; 173/217

[58] Field of Search ..... 173/217, 216, 173/29, 171, 170; 81/177.8, 177.85, 180.1; 403/160, 161, 375; 279/48

[56] References Cited

U.S. PATENT DOCUMENTS

| | | | |
|---|---|---|---|
| 1,325,407 | 12/1919 | Morgan | 81/177.8 |
| 2,542,038 | 2/1951 | Lewis | 403/160 |
| 3,213,273 | 10/1965 | Zagel | 403/161 |
| 3,724,237 | 4/1973 | Wood | 173/29 |
| 4,522,270 | 6/1985 | Kishi | 173/217 |
| 4,759,240 | 7/1988 | Lin | 81/177.8 |
| 5,033,552 | 7/1991 | Hu | 173/217 |
| 5,052,496 | 10/1991 | Albert et al. | 173/171 |
| 5,251,706 | 10/1993 | Evans | 173/217 |
| 5,372,420 | 12/1994 | Van Deursen et al. | 173/217 |
| 5,624,000 | 4/1997 | Miller | 173/216 |

*Primary Examiner*—Peter Vo
*Assistant Examiner*—Jim Calve
*Attorney, Agent, or Firm*—Bacon & Thomas

[57] ABSTRACT

A multi-usage electric tool includes an angle-changeable grip, a main body and an electric tool head. The grip and the main body are formed with corresponding inclined adjoining faces for movably connecting the grip with the main body. The inclined face of the grip is disposed with a guide rib and the inclined face of the main body is disposed with an arch guide slot. The guide rib is slidably fitted in the guide slot, whereby the grip can be rotated relative to the main body through a certain angle along the guide slot so as to change the angle contained by the grip and the main body. One end of the main body is disposed with an engaging mechanism and one end of the tool head is disposed with an engaging mechanism corresponding to the engaging mechanism of the main body for detachably engaging the tool head with the main body. The tool head is easily replaceably assembled with the main body, whereby a user can conveniently change the tool head for different usages.

6 Claims, 17 Drawing Sheets

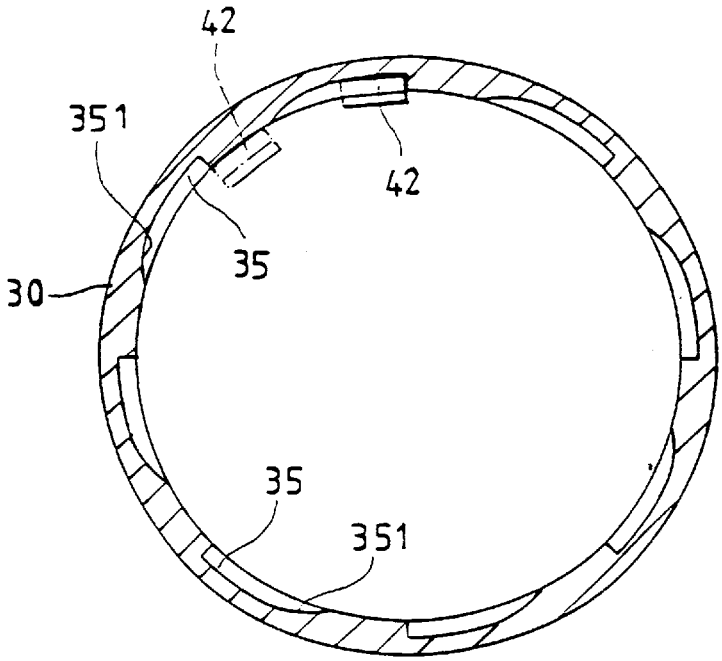
FIG. 9
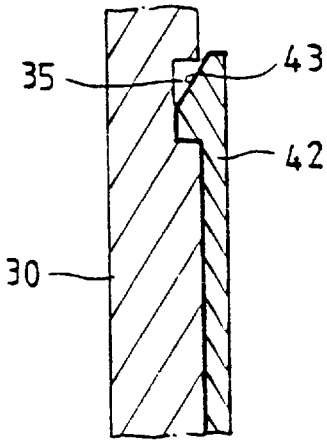
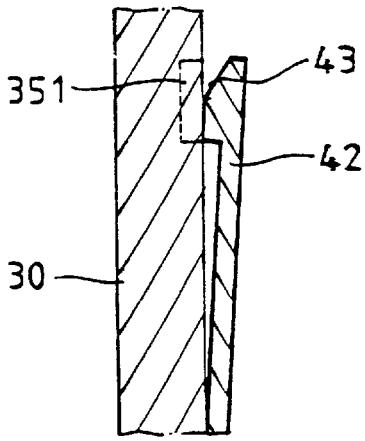
FIG. 10-1 FIG. 10-2

MULTI-USAGE ELECTRIC TOOL WITH ANGLE-CHANGEABLE GRIP

BACKGROUND OF THE INVENTION

The present invention relates to a multi-usage electric tool, and more particularly to an electric tool in which the grip is rotatable relative to the main body so as to change the angle contained by the grip and the main body. The main body and the electric tool head are disposed with engaging mechanisms which enable a user to quickly assemble the tool head with the main body or disassemble the tool head from the main body so as to change the tool head for different usages.

Many kinds of electric tools are widely used in various fields. For example, an electric socket wrench is used to tighten and untighten car wheel nuts and an electric jack is used to lift a car for service. However, in most of the existing electric tools, the main body and the transmission mechanism are formed as an integral body, that is, the main body cannot be disassembled from the tool head. Therefore, one kind of electric tool can be applied to only one kind of work. As a result, a consumer often needs to perchase various kinds of electric tools for different usages. This leads to increment of cost and inconvenience in operation of these tools.

Moreover, the existing electric tool has a fixed grip for a user to hold. The holding angle of such fixed grip cannot be adjusted to meet different operation situations.

SUMMARY OF THE INVENTION

It is therefore a primary object of the present invention to provide a multi-usage electric tool in which a user can selectively replaceably connect electric tools, such as electric drill, screwdriver and grinder, with the same main body in accordance with the requirements of working. Also, the same main body can be selectively connected with various kinds of car-used electric tools such as electric waxer, vacuum cleaner, socket wrench and electric jack. The tool head can be quickly assembled with the main body or disassembled from the main body. Therefore, the cost for perchasing the electric tool is reduced and the operation of the electric tool is facilitated.

It is a further object of the present invention to provide the above electric tool in which the grip is rotatable relative to the main body so as to change the angle contained by the grip and the main body for widening and facilitating application of the electric tool.

According to the above objects, the electric tool of the present invention includes a grip, a main body and an electric tool head. The lower end of the grip and the upper end of the main body are formed with corresponding inclined adjoining faces. The center portions of the inclined faces are movably connected with each other, whereby the grip can be rotated relative to the main body to change the angle contained thereby and form a pen pattern or a handgun pattern. A power motor is installed in the main body. A driving shaft of the motor extends out of the main body. An engaging mechanism is disposed at a lower end of the main body. A lower end of the tool head is replaceably connected with an electric tool. A power transmission mechanism or a reducing mechanism is received in the tool head. An upper end of the tool head is disposed with an engaging mechanism for assembling with or disassembling from the engaging mechanism of the main body. The power of the driving shaft is transmitted by the power transmission mechanism or the reducing mechanism to the lower end of the tool head.

The tool head is detachably locked with the main body via a locking ring by means of tight fit, screwing, latching or rotary insertion.

The present invention can be best understood through the following description and accompanying drawings, wherein:

BRIEF DESCRIPTION OF THE DRAWINGS

FIG. 3-1 shows that the grip and the main body are connected in a pen pattern;

FIG. 3-2 shows that the grip and the main body are connected to contain a certain angle;

FIG. 5-1 is a cross-sectional assembled view of the main body, locking ring and electric tool head of the first embodiment of the present invention in one state;

FIG. 5-2 is a cross-sectional assembled view of the main body, locking ring and electric tool head of the first embodiment of the present invention in another state;

FIG. 9 is a cross-sectional view according to FIG. 8, showing the positions of the clamp claw in latching state and unlatching state;

FIG. 10-1 is a longitudinally sectional view of a part of the second embodiment of the present invention, showing the latching state of the clamp claw;

FIG. 10-2 is a longitudinally sectional view of a part of the second embodiment of the present invention, showing the unlatching state of the clamp claw;

FIGS. 18-1, 18-2 and 18-3 show that the electric tool heads of the present invention can be electric screwdriver, electric grinder and electric waxer.

DETAILED DESCRIPTION OF THE PREFERRED EMBODIMENTS

Figure 1:
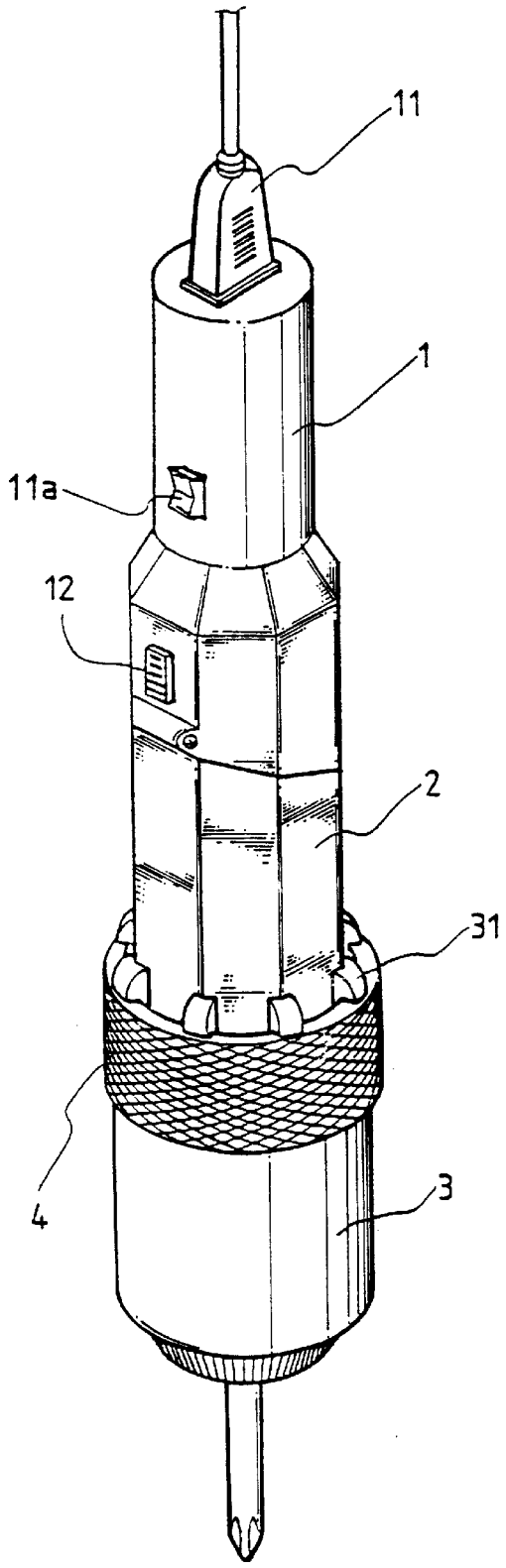
FIG. 1 is a perspective view of a first embodiment of the present invention.

Please refer to FIG. 1. According to a first embodiment of the present invention, the electric tool includes a grip 1, a main body 2, a tool head 3 and a locking ring 4. The grip and the main body are shaped as a polygonal stem. The grip 1 is formed with a socket for insertion of a power plug 11 so as to externally connect with domestic AC power, car-used DC power or other power sources such as a general battery. A locating key 12 is disposed at a certain portion of the grip 1. In use, the locating key 12 can be shifted to release the grip from being located with the main body, permitting the grip 1 to rotate relative to the main body 2 through a certain angle for facilitating the holding and forcing of a user. The grip 1 is further disposed with a three-stage power switch 11*a* for controlling on/off, clockwise rotation and counterclockwise rotation of the tool. The electric tool head 3 (which is an electric screwdriver in this embodiment) has fitting clamp claws 31 at upper end for fitting with an end of the main body 2. The locking ring 4 is fitted around the tool head 3 for tightening and fixing the tool head 3.

Figure 2:
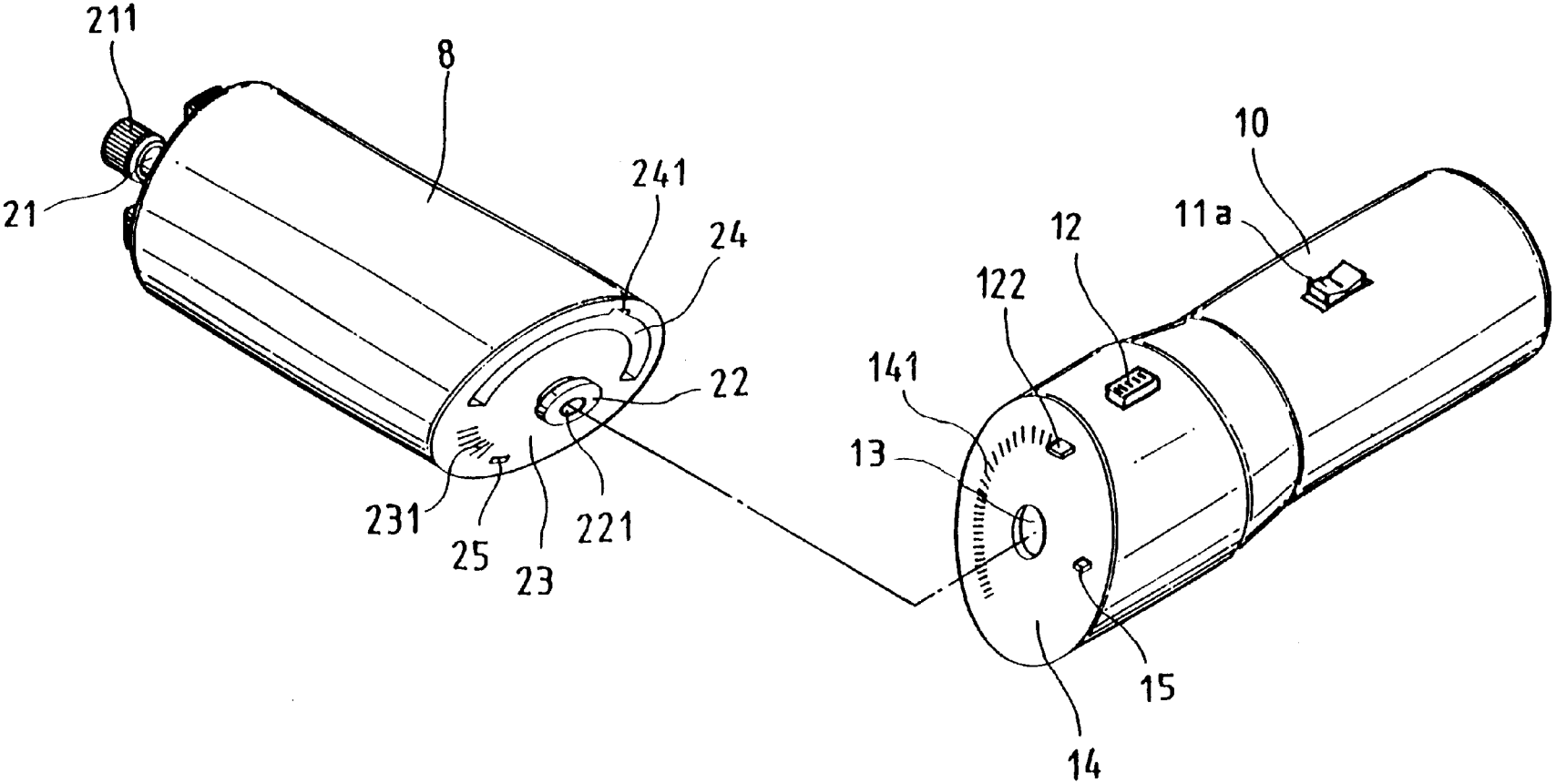
FIG. 2 is a perspective view of the first embodiment of the present invention, showing that the grip and the main body are connected on the inclined faces.
Figures 1, 3:
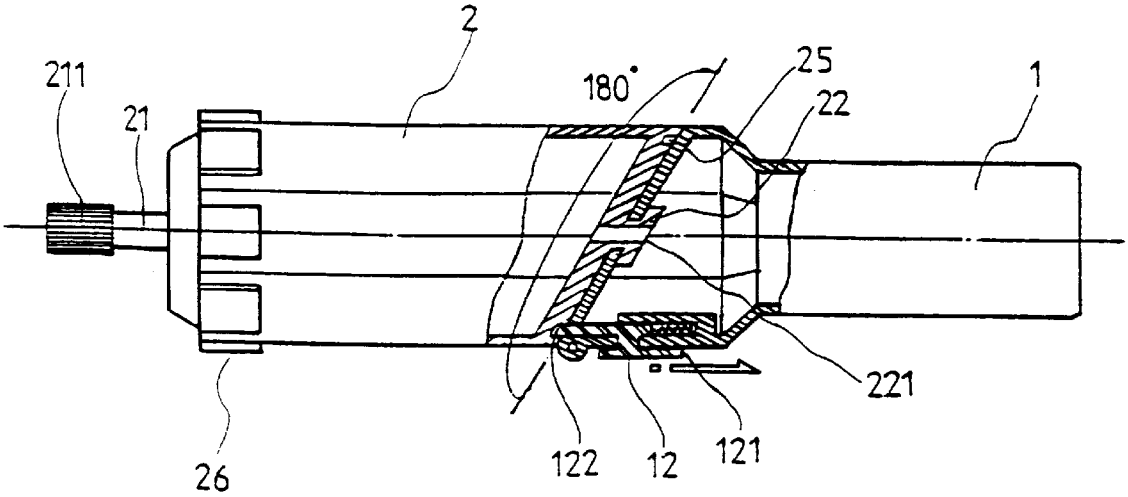
Figures 2, 3:
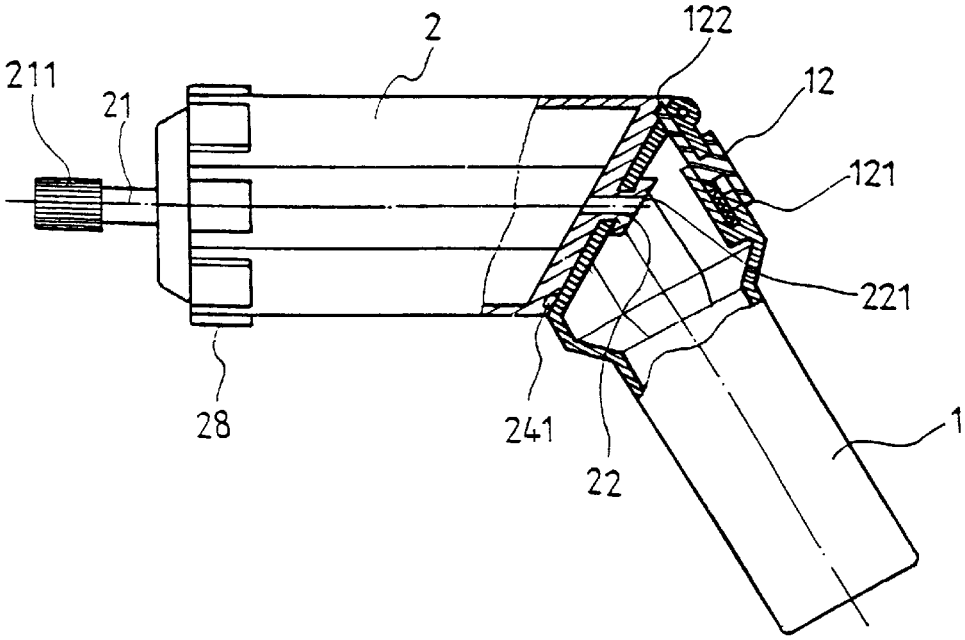

Referring to FIGS. 2, 3-1, 3-2, a power motor 8 is installed in the main body 2. A driving shaft 21 is fitted with a pinion 211 and extends out of the main body 2. The main body 2 is mated with an outer casing of the grip 1. A T-shaped fitting post 22 projecting from the center of upper end face of the main body 2 extends into a fitting hole 13 formed at the center of the end face of the grip 1, whereby the grip 1 can coaxially rotate relative to the main body 2 without detachment. The center of the T-shaped fitting post 22 is formed with a wire hole 221, permitting a power wire to extend from the fitting hole 13 into the main body 2 for supplying power to the power motor. The adjoining portions of the grip 1 and the main body 2 contact with each other on inclined faces 14, 23 of a predetermined inclination angle. The inclined face 23 is formed with an arch guide slot 24 into which a guide rib 15 projecting from the inclined face 14 extends. A resilient member 121 is disposed in the locating key 12 of the grip 1 to resiliently push the locating key 12 and make a front protruding end 122 thereof extend into a locating hole 241 of the inclined face 23 so as to fix the grip 1 without further rotation.

When it is desired to change the angle of the grip, the locating key 12 is shifted to retract the protruding end 122 from the locating hole 241. At this time, the grip 1 can be rotated with the guide rib 15 sliding along the arch guide slot 24. When the guide rib 15 slides to the other close end of the guide slot 24, the grip 1 cannot be further rotated. In the first embodiment, the guide slot 24 is designed to extend through an angle of 180 degrees, so that the grip 1 can be rotated through 180 degrees from a linear state with the main body 2 to a handgun grip state. After rotating, the protruding end 122 of the locating key 12 extends into another fixing hole 25 of the inclined face 23 to fix the grip 1. Accordingly, the angle contained by the grip 1 and the main body 2 can be selectively changed for facilitating operation. In addition, in order to prevent the grip 1 from slipping on the adjoining face between the grip 1 and the main body 2 during rotation, the inclined faces 14, 23 are formed with projecting strips 141, 231 for providing a certain frictional resistance.

Figure 4:
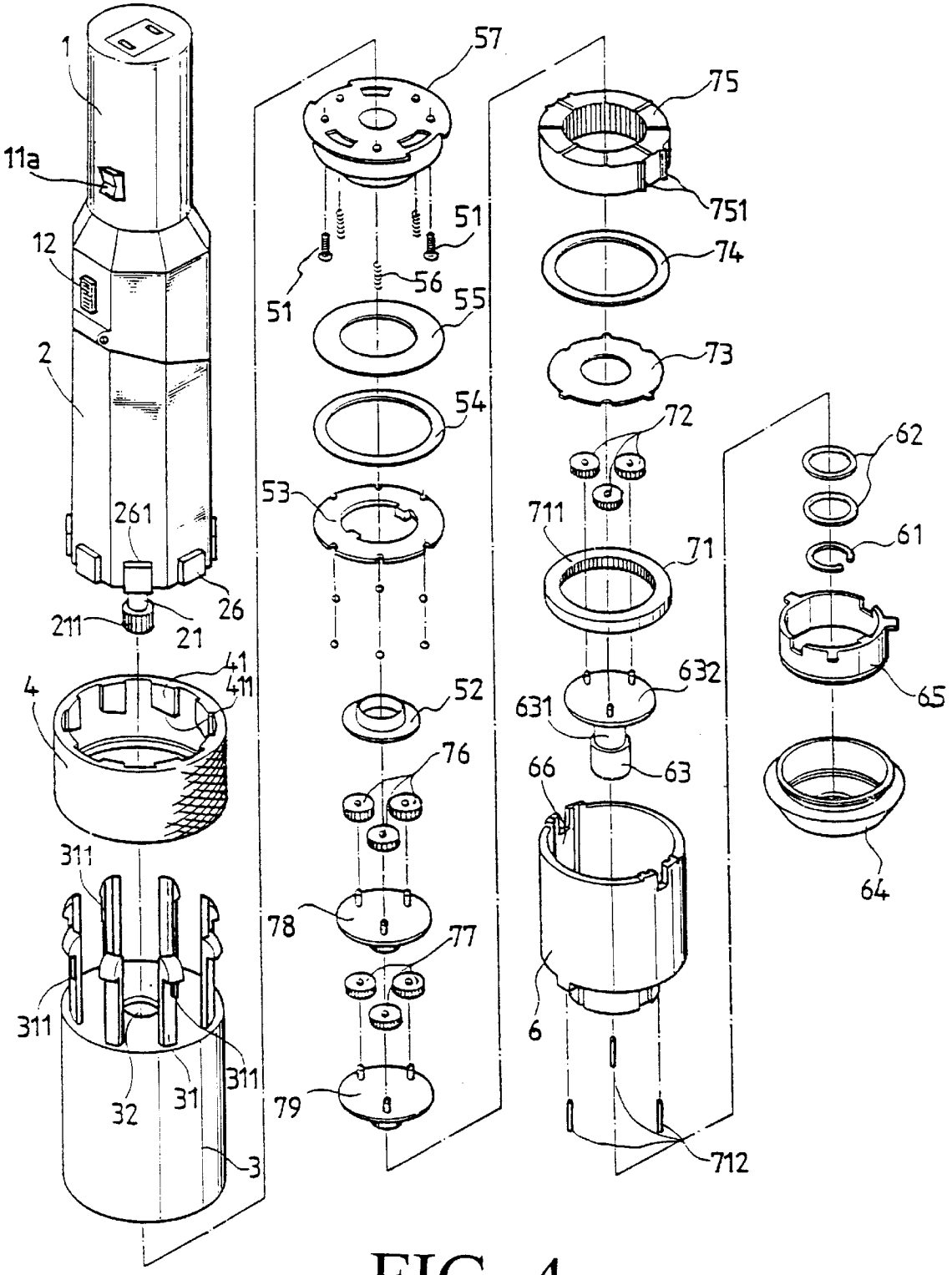
FIG. 4 is a perspective exploded view of the first embodiment of the present invention.

As shown in FIG. 4, in the first embodiment, a reducing transmission mechanism is received in the tool head 3. Most parts of the mechanism are conventional members. A torque safety device is fixed on the inner side of the bottom of the tool head 3 by screws 51. The torque safety device is composed of a bush 52, a steel ball tray 53, washers 54, 55, resilient member 56 and tray seat 57. A torque safety device is installed in a gear cylinder 6. The bottom of the gear cylinder 6 is fitted in an annular groove 631 of a shaft rod 63 via a C-shaped ring 61 and an iron O-ring 62, whereby the shaft rod 63 is rotatably fixed. A front cap 64 and a collar 65 are fitted with a front open end of the tool head 3 in a close state. The shaft rod 63 extends out of the front cap 64 for mounting a screwdriver therein. A gear ring 71 having annularly arranged inner teeth 711 is first placed into the gear cylinder 6 and three pin members 712 are driven in to make the gear ring 71 engaged with a shaft rod disc 632. Three planet gears 72 are rotatably mounted on the shaft rod disc 632 with the teeth meshing with the inner teeth 711 of the gear ring 71 to form a planet gear set. Washers 73, 74 are placed on the gear ring 71 and then another gear ring 75 is placed in. The gear ring 75 is formed with parallel engaging ribs 751 on lateral sides for engaging with engaging channels 66 formed on inner wall of the gear cylinder 6 without rotation. Two sets of planet gears 76, 77 and two diaphragm boards 78, 79 are placed into the gear ring 75. Accordingly, when the tool head 3 is assembled with the main body 2, the driving shaft 21 of the main body 2 extends through a through hole 32 of upper connecting end of the tool head 3 into the tool head 3. The pinion 211 is engaged with the three planet gears 76, whereby by means of the transmission of the planet gear sets, the speed of the shaft rod 63 is reduced and the torque of the shaft rod 63 is increased.

Figures 1, 5:
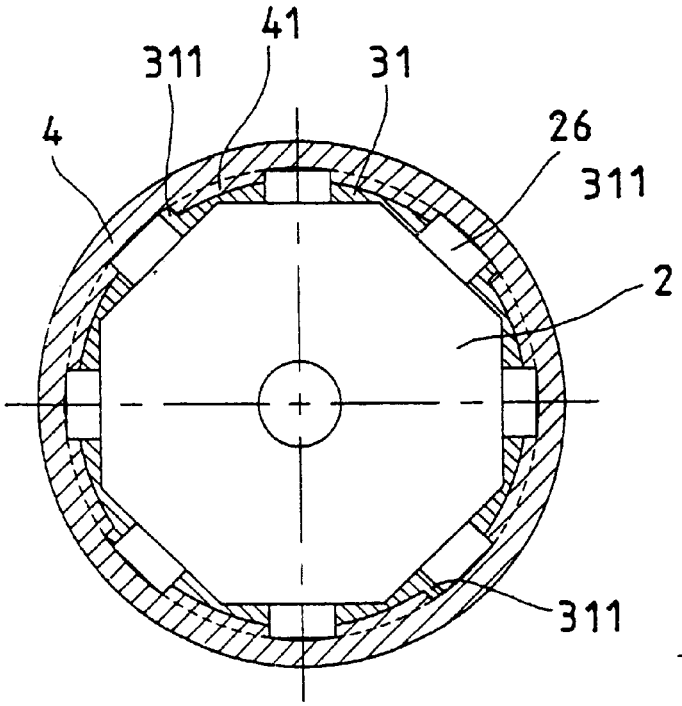
Figures 2, 5:
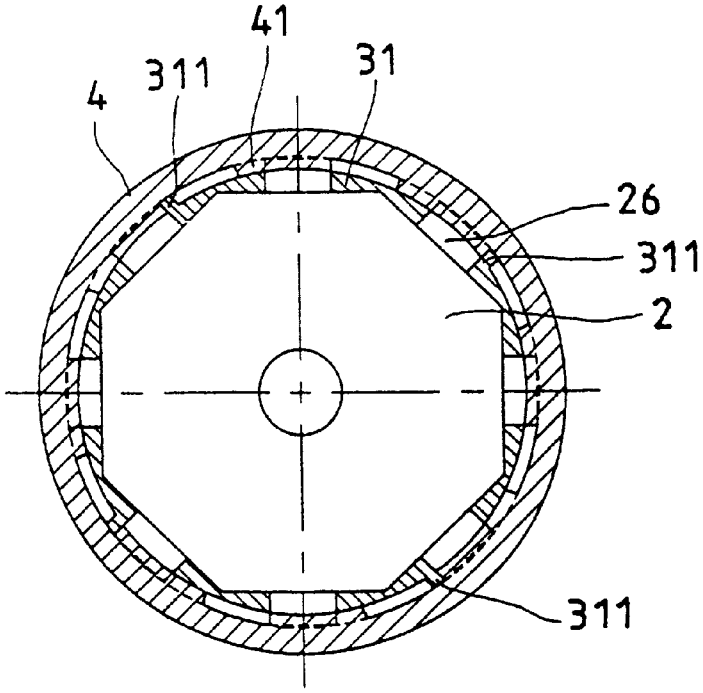
Figure 6:
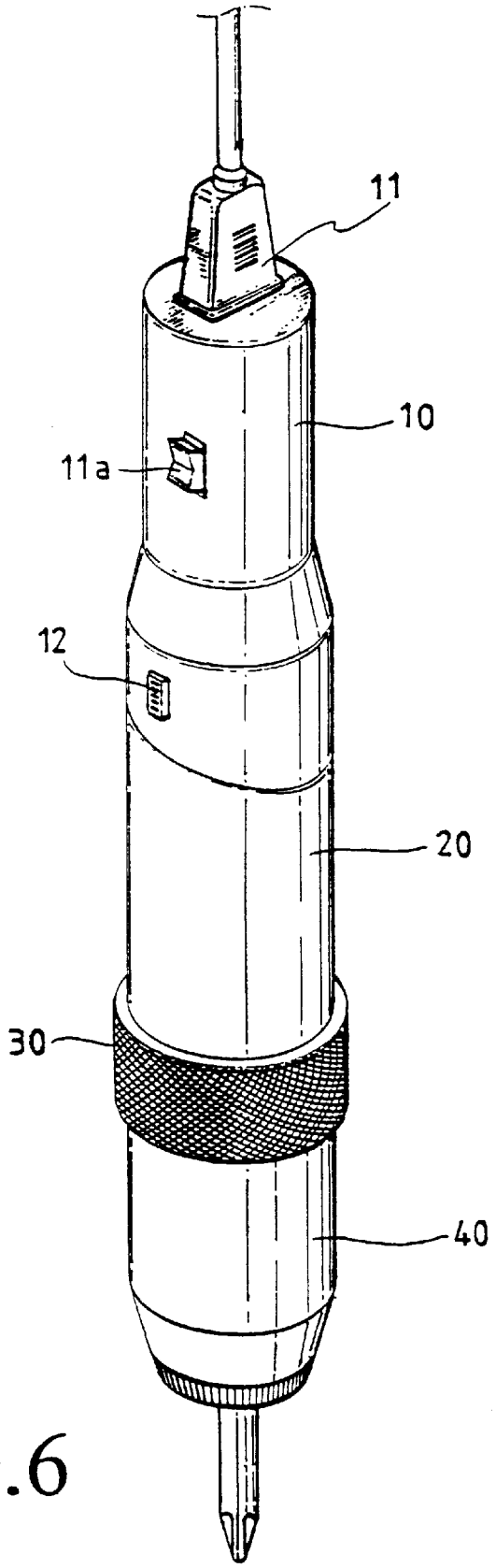
FIG. 6 is a perspective view of a second embodiment of the present invention.
Figure 7:
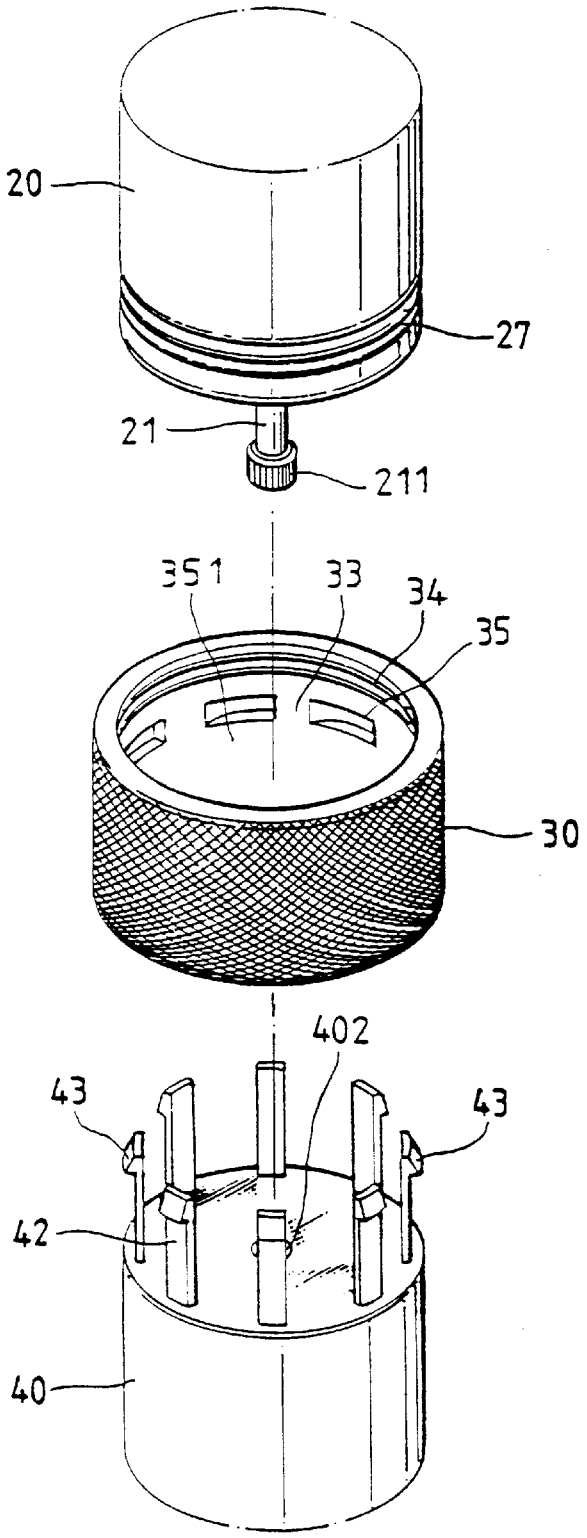
FIG. 7 is a perspective exploded view of the main body, locking ring and tool head of the second embodiment of the present invention.

Please refer to FIGS. 4, 5-1 and 5-2 which show the quickly detachably assembling structure of the main body 2 and the tool head 3 of the first embodiment. The plane faces of the front end of the main body 2 are disposed with fixing blocks 26 and the several annularly arranged upright fitting clamp claws 31 upward extend from upper end of the tool head 3. The clamp claws 31 are resilient so that they can be slightly compressed to reduce the outer diameter, permitting the locking ring 4 to fit therearound. The free end of the clamp claw 31 is formed with a triangular hook section 312 which prevents the locking ring 4 from detaching from the clamp claw without affecting the rotation of the locking ring 4. The inner wall of the locking ring 4 is formed with several fixing slope plates 41, whereby when the main body 2 is assembled with the tool head 3, the locking ring 4 can be rotated to make the fixing slope plates 41 rotate to the outer side of the clamp claws 31 to form an inner layer and an outer layer overlaid thereon as shown in FIG. 5-1. At least several clamp claws 31 are formed with stopper ribs 311 on lateral sides for stopping the fixing slope plates 41 from further rotating. At this time, the clamp claws 31 is fitted in the gaps defined by the fixing blocks 26 and stopped by the fixing blocks 26, whereby the tool head 3 and the clamp claws 31 are prevented from further rotating. When the locking ring 4 is reversely rotated as shown in FIG. 5-2, the fixing slope plates 41 are rotated to outer sides of the gaps between the clamp claws 31. During rotation, the slope face 411 on lower side of the fixing slope plate 41 will slowly abut against and force the stopper face 261 on the upper side of the fixing block 26. At this time, the tool head 3 and the locking ring 4 cannot be axially separated from the main body 2 so that the main body 2 is locked with the tool head 3. During the locking procedure, the fixing slope plates 41 are stopped by the stopper blocks 311 from over-rotating. Similarly, when it is desired to disassemble the tool head 3 from the main body 2, the locking ring 4 is reversely rotated back to its original state. At this time, the tool head 3 can be detached from the main body 2 and replaced by another tool head for different use.

FIGS. 6 to 10-2 show a second embodiment of the present invention, which is composed of a grip 10, a main body 20, a locking ring 30 and an electric tool head 40. The grip and the main body are formed as a cylindrical stem. The end of the main body 20 is formed with several annular engaging grooves 27. The inner wall 33 of the locking ring is formed with several annular ribs 34 for screwing or engaging with the annular engaging grooves 27. Also, the inner wall 33 is formed with several latch cavities 35 each having an arch slide way 351. The tool head 40 is formed with a central through hole 402 through which the pinion 211 of the driving shaft 21 of the main body is passed for transmitting power to the reducing gear set 44. Multiple latching clamp claws 42 upward extend from the periphery of upper end of the tool head 40. The free end of each clamp claw 42 is formed with a slope conic engaging section 43. When assembled, the annular ribs 32 of the locking ring 30 are engaged with the annular engaging grooves 26 of the main body 20 so as to lock the locking ring 30 with the main body 20.

When it is desired to quickly assemble the tool head 40 with the main body 20, the clamp claws 42 of the tool head 40 are inserted into the inner hole of the locking ring 30 with the conic engaging sections 43 abutting against the inner wall 33 of the locking ring 30. Then the tool head 40 is slightly rotated to make the clamp claws 42 slide into the latch cavities 35 and become tightly latched therein as shown in FIGS. 9 and 10-1. When disassembling the tool head 40, the locking ring 30 is rotated in a reverse direction, making the conic engaging sections 43 of the resilient clamp claws 42 retract by the bottom faces of the arch slide ways 351. Therefore, the conic engaging sections 43 can be withdrawn from the latch cavities 35 of the locking ring as shown in FIG. 10-2. At this time, the clamp claws 42 can be slided on the smooth inner wall 33 of the locking ring 30 and the tool head 40 can be pulled out of the locking ring 30.

FIGS. 11 to 17 show a third embodiment of the present invention. A lower end of the main body 8 is disposed with several engaging blocks 826 which radially outward project. The outer edge of the engaging block is gradually thickened and expanded, whereby a first side a of the engaging block has a thickness less than the thickness of a second side b of the engaging block. In addition, the outer edge face of the engaging block is formed with projecting stripes 827.

The upper end of the tool head 9 is disposed with an engaging recess 931. The inner peripheral wall 934 of the engaging recess 931 is formed with radially arranged abutting faces 935. The upper edge of the engaging recess 931 is formed with notches 933 corresponding to the engaging blocks 826. The abutting faces 935 are formed with projecting stripes 936.

When assembled, the engaging blocks 826 of the main body 8 are aligned with and inserted into the notches 933. Then the engaging blocks 826 are slided into the engaging recess 931 of the tool head. Then the tool head is rotated relative to the main body, whereby the engaging blocks 826 are moved to frictionally tightly engage with the abutting faces 935. The greater the rotating force is, the more tightly the engaging blocks 826 are engaged with the abutting faces 935.

When it is desired to disassemble the main body 8 from the tool head 9, the main body 8 is rotated in reverse direction to untighten the engaging blocks 826. Then the engaging blocks 826 are withdrawn from the notches 933 to detach the tool head from the main body.

In conclusion, the angle contained by the grip and the main body of the electric tool of the present invention can be changed to meet the requirements of different application situtions. Moreover, the engaging mechanisms of the main body and the tool head enables a user to quickly selectively assemble different tool heads with the same main body.

Figure 8:
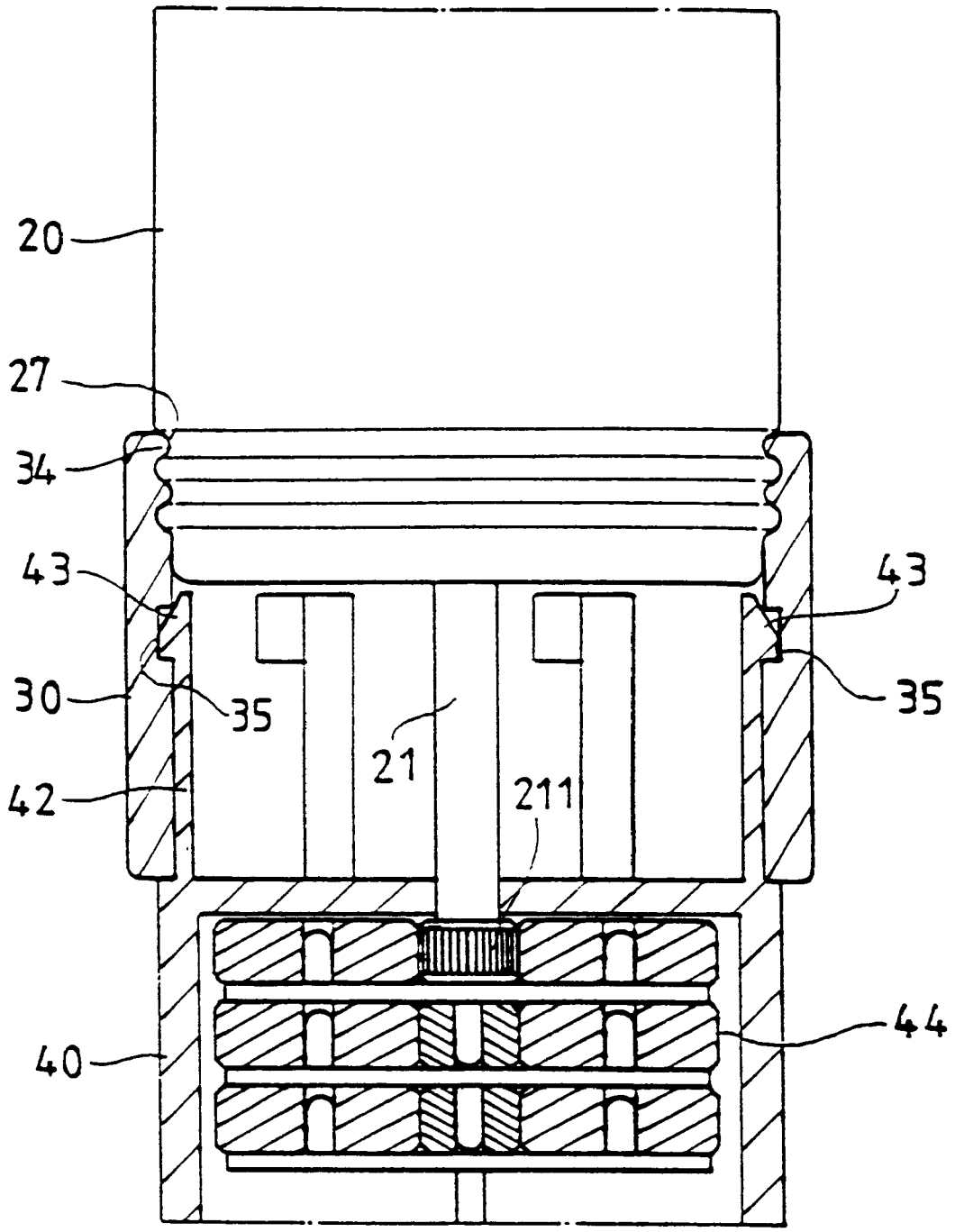
FIG. 8 is a longitudinally sectional assembled view of the main body, locking ring and tool head of the second embodiment of the present invention.
Figure 11:
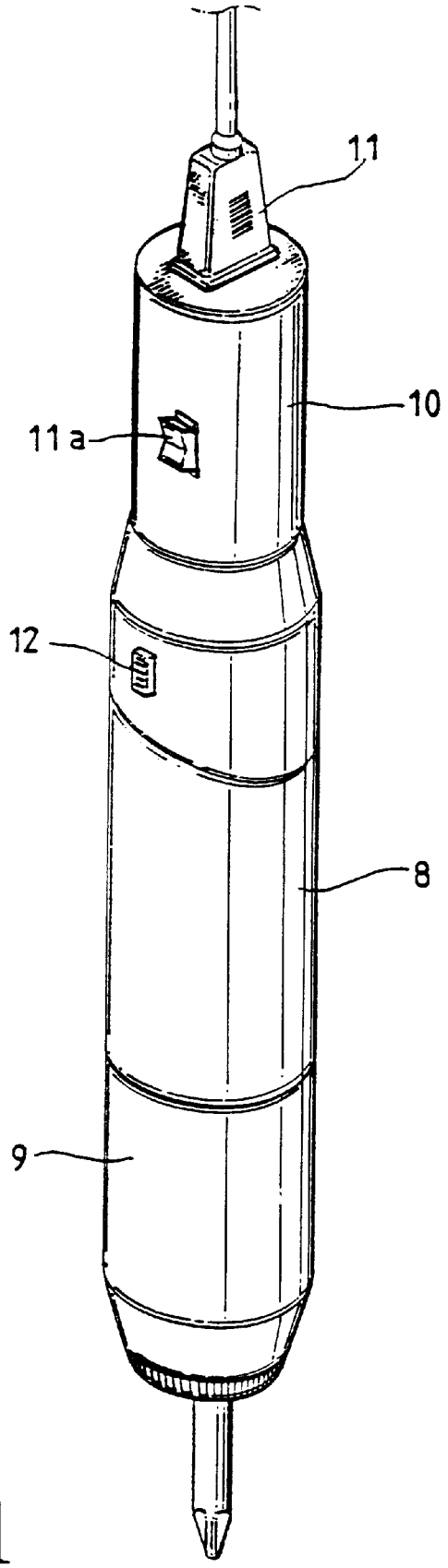
FIG. 11 is a perspective view of a third embodiment of the present invention.
Figure 12:
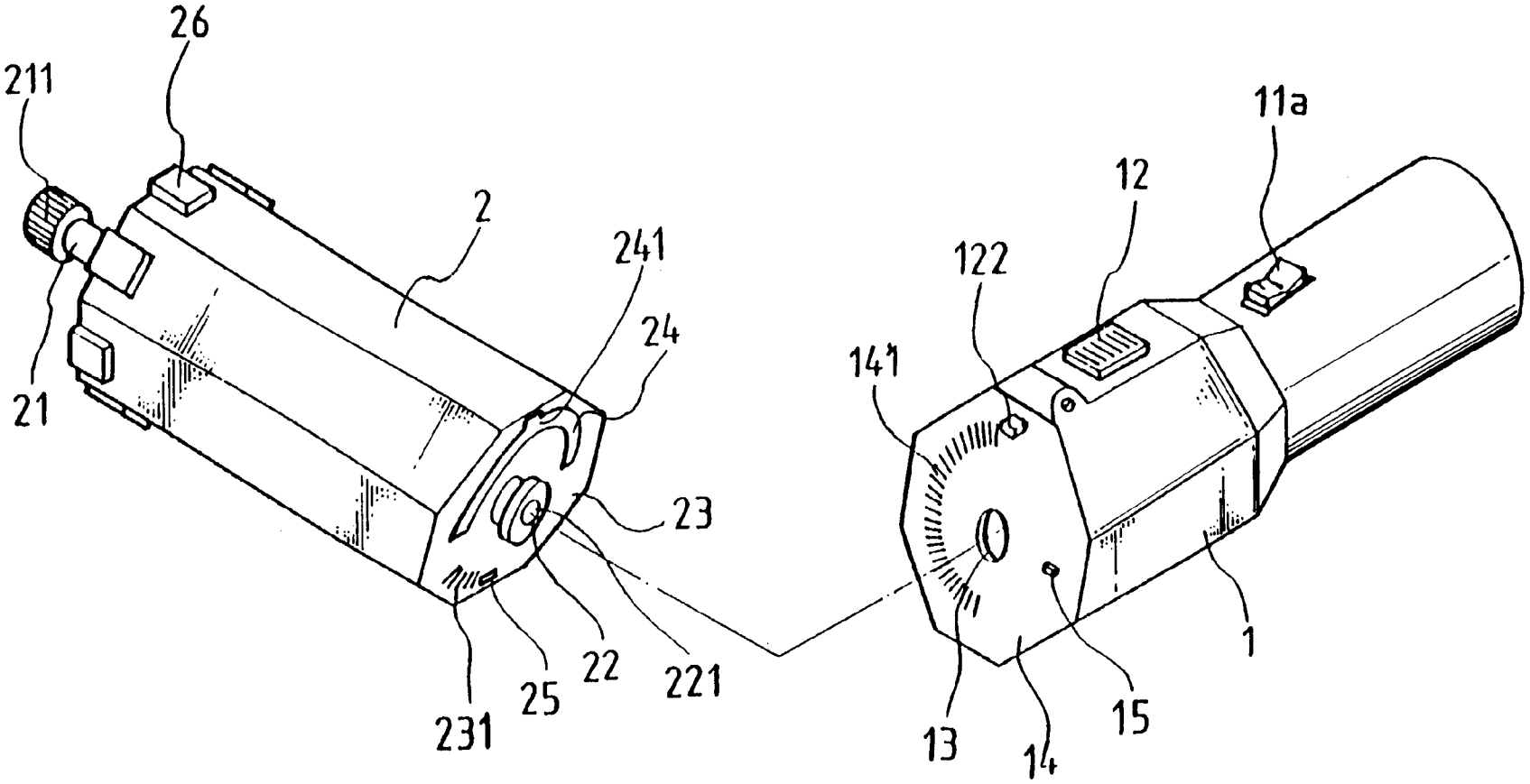
FIG. 12 is a perspective exploded view of the grip and main body of the third embodiment of the present invention.
Figure 13:
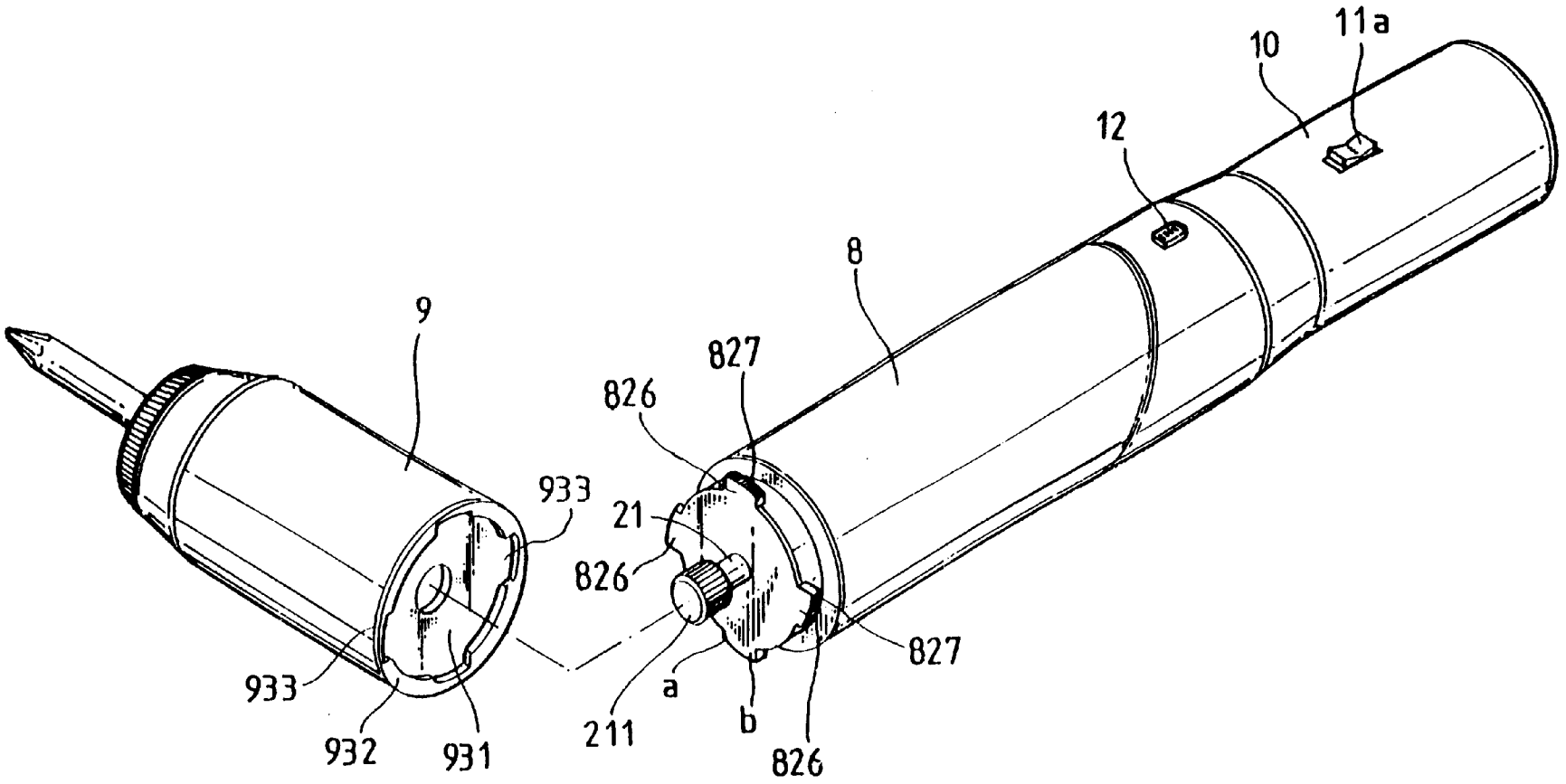
FIG. 13 is a perspective view showing the engaging mechanisms of the main body and the tool head of the third embodiment of the present invention.
Figure 14:
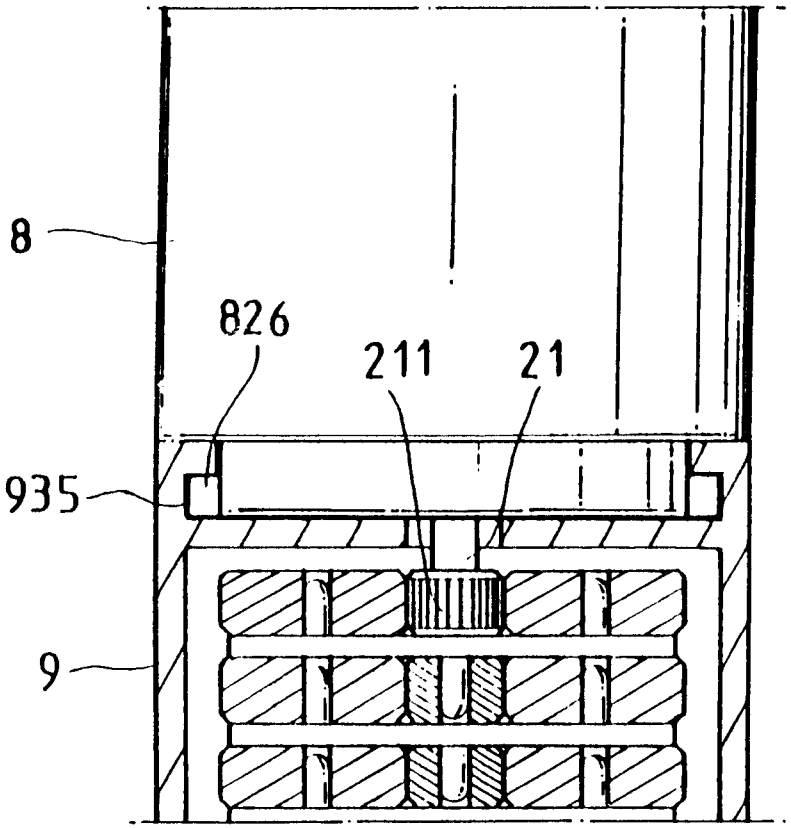
FIG. 14 is a sectional assembled view showing the engaging mechanisms of the main body and the tool head of the third embodiment of the present invention.
Figure 15:
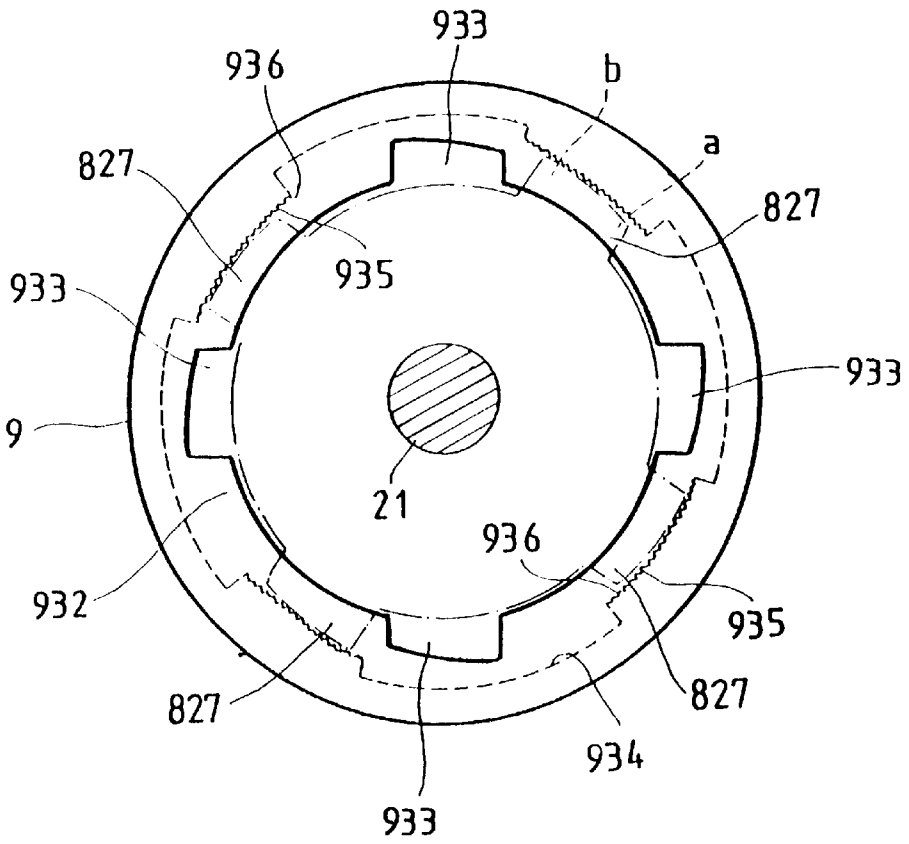
FIG. 15 is a cross-sectional view showing the engaging recess and the notch of the tool head of the third embodiment of the present invention.
Figure 17:
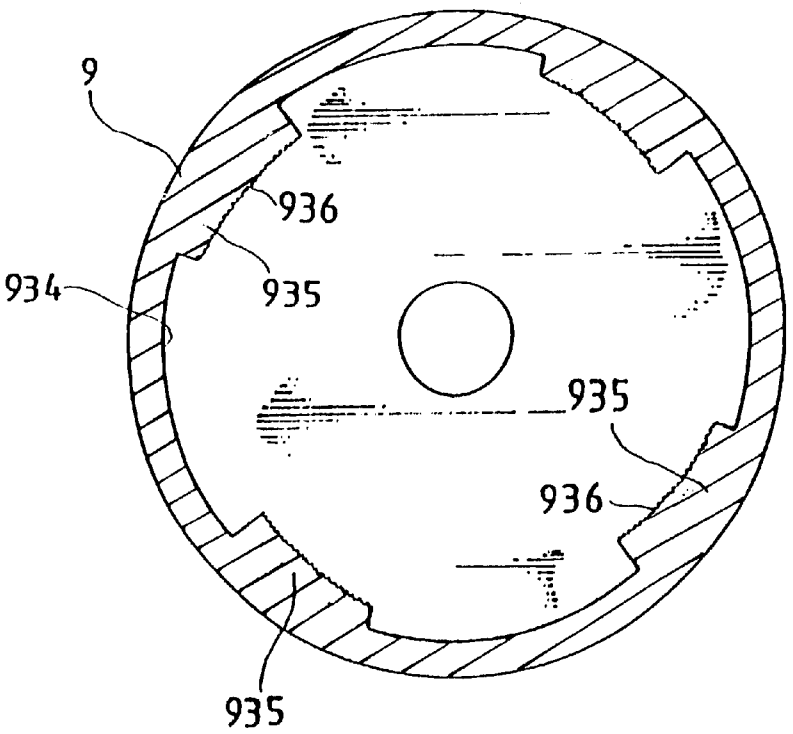
FIG. 17 is a cross-sectional view showing that the engaging block of the main body is disengaged from the engaging recess of the tool head of the third embodiment of the present invention.
Figure 16:
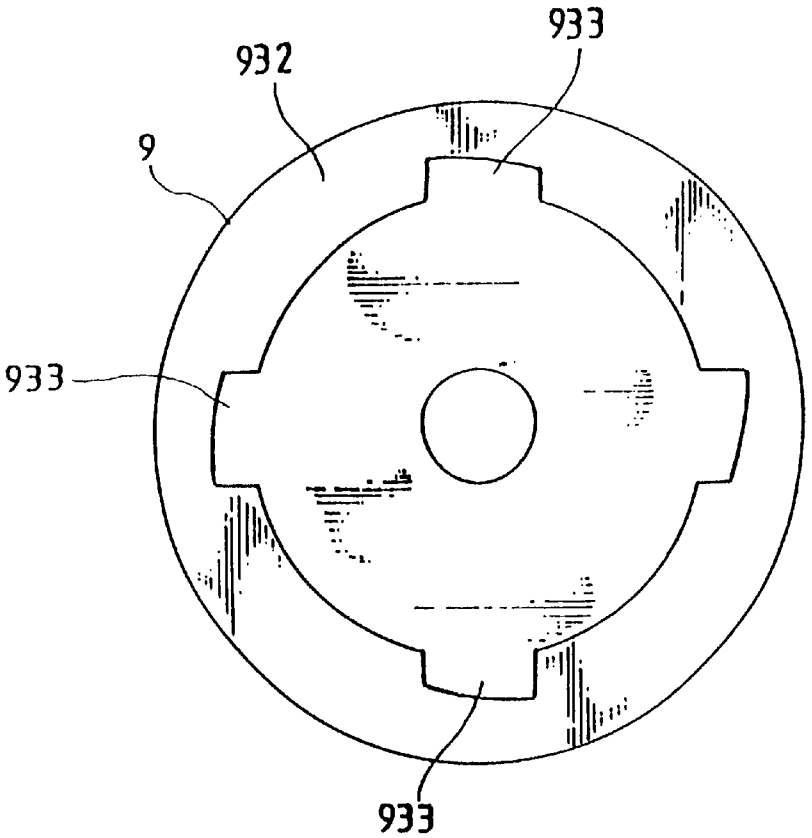
FIG. 16 is a cross-sectional view showing the annular groove of the engaging recess of the tool head of the third embodiment of the present invention.
Figures 1, 18:
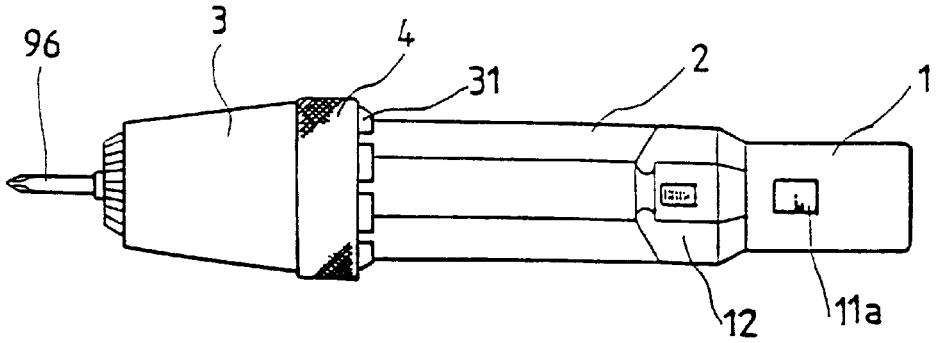
Figures 2, 18:
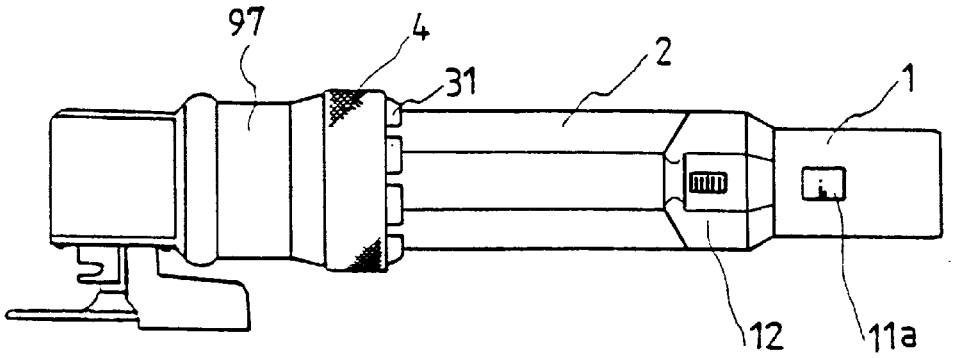
Figures 3, 18:
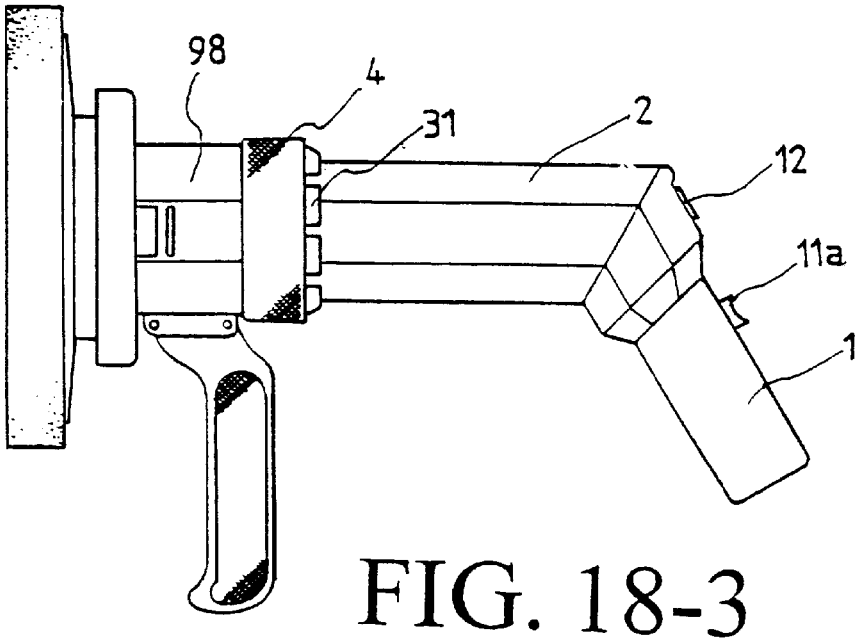
Figure 19:
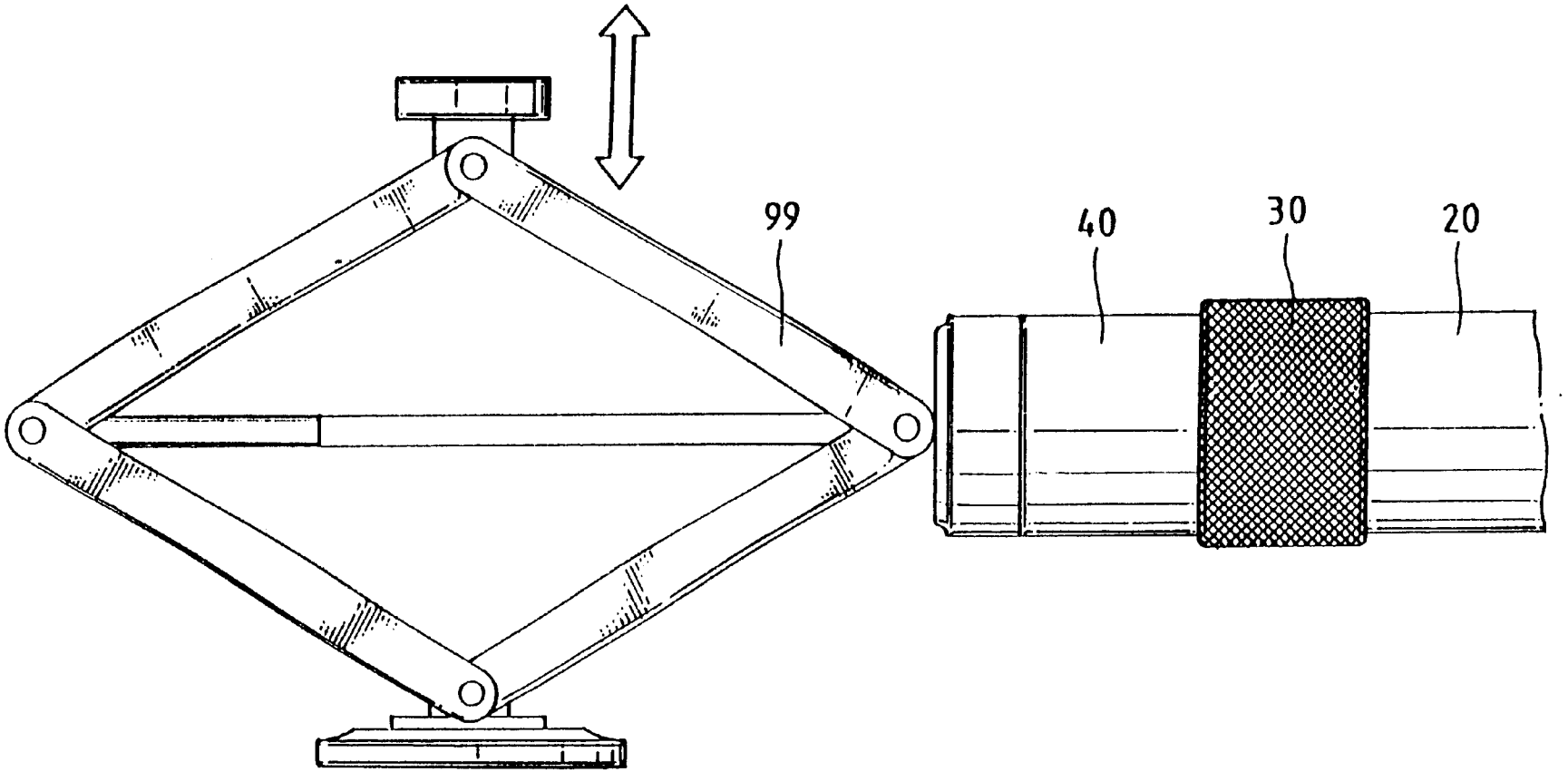
FIG. 19 shows that the present invention is applicable to an electric jack.

It should be noted that the above description and accompanying drawings are only used to illustrate some embodiments of the present invention, not intended to limit the scope thereof. Any modification of the embodiments should fall within the scope of the present invention. For example, the grip and main body of the present invention can have polygonal, cylindrical or otherwise shape. In addition, as shown in FIGS. 18-1, 18-2, 18-3 and 19, the present invention is applicable as an electric screwdriver, grinder, waxer, jack, etc. In fact, the present invention are also applicable as other domestic or car-used electric appliances such as electric drill, socket wrench, cutter, vacuum cleaner. Also, the reducing mechanism installed in the tool head as shown in FIGS. 4 and 8 can be replaced by other transmission or reducing mechanism according to the usage of the tool head.

What is claimed is:

1. A multi-usage electric tool with angle-changeable grip and a plurality of interchangeable tool heads, comprising:

a grip, an upper end of the grip being disposed with a power socket for connecting with an external power source, a portion of the grip being formed as a stem, a lower end of the grip being formed with an inclined face;

a main body, an upper end of the main body being formed with an inclined face corresponding to the inclined face of the grip, the main body being movably connected with the grip at a central portion, whereby the grip is rotatable relative to the main body to change an angle between the grip and the main body, a power motor being installed in the main body, a driving shaft of the motor extending out of the main body, and an engaging mechanism being disposed at a lower end of the main body;

an electric tool head, a lower end of the tool head being replaceably connected with an electric tool, a power transmission mechanism being received in the tool head, an upper end of the tool head being disposed with an engaging mechanism for assembling with or disassembling from the engaging mechanism of the main body, the power of the driving shaft being transmitted by the power transmission mechanism to the lower end of the tool head; and a removable locking ring that extends around an end of the main body to which the tool head is to be secured, wherein an outer periphery of the lower end of the main body includes a plurality of fixing blocks that extend radially outwardly therefrom, each of said fixing blocks having an engaging surface that faces away from the tool head when the tool head is secured to the main body by the locking ring, wherein an inner wall of the locking ring includes fixing slope plates extending radially inwardly therefrom, a number of said fixing slope plates equaling a number of said fixing blocks and a lower side of each fixing slope plate that faces the tool head when the tool head is secured to the main body by the locking ring being formed with an inclined face, said inclined face being arranged to tightly engage an upper end face of a respective fixing block when said locking ring is fitted over the main body such that said fixing plates pass through gaps between said fixing blocks, and then are rotated to cause respective said inclined faces and engaging surfaces to engage each other, wherein said tool head has extending therefrom a plurality of clamp claws having outwardly extending projections, said clamp claws being positioned in said gaps between the fixing blocks as the tool head is brought into engagement with the main body, and secured in the gaps upon rotation of the locking ring, wherein engagement of said inclined faces of the fixing plates and said engaging surfaces of the fixing blocks causes an end of the locking ring to press against said outwardly extending projections to secure the main body on the tool head, and wherein at least several clamp claws include radially extending stopper ribs that engage vertical sides of the fixing plates for preventing the locking ring from rotating beyond a position at which the tool head is secured to said main body.

2. An electric tool as claimed in claim 1, wherein a center portion of the inclined face of the grip is formed with a fitting hole and a center of the inclined face of the main body includes a T-shaped fitting post, the T-shaped fitting post being fitted into the fitting hole to connect the main body with the grip, the T-shaped fitting post being formed with a central wire hole communicating with the fitting hole for a power wire to pass therethrough, a periphery of the inclined face of the main body being formed with an arch guide slot, the inclined face of the grip being formed with a guide rib corresponding to the guide slot, whereby the guide rib is slidable along the guide slot to guide rotation of the grip relative to the main body.

3. An electric tool as claimed in claim 1, wherein the inclined face of the grip includes a protrusion resiliently protruding beyond the inclined face, the inclined face of the main body being formed with a locating hole and a fixing hole corresponding to the protrusion, whereby when the grip is rotated relative to the main body to form a handgun grip pattern, the protrusion extends into the locating hole to lock the grip with the main body, while when the grip is rotated relative to the main body to form a straight pattern, the protrusion extends into the fixing hole to lock the grip relative to the main body.

4. An electric tool as claimed in claim 3, wherein whether the protrusion protrudes beyond the inclined face of the grip is controlled by a locating key disposed on the grip.

5. An electric tool as claimed in claim 1, wherein the inclined faces of the grip and the main body are formed with projecting strips for providing frictional resistance during relative rotation of the grip and the main body.

6. An electric tool as claimed in claim 1, wherein an on/off power switch is disposed on the grip, said on/off power switch being arranged to also control clockwise and counterclockwise rotation of the motor.

* * * * *